United States Patent [19]

Schwartz et al.

[11] Patent Number: 4,932,653

[45] Date of Patent: Jun. 12, 1990

[54] STRENGTH-ENDURANCE EXERCISE APPARATUS

[75] Inventors: Leonard Schwartz, 5526 Northumberland St., Pittsburgh, Pa. 15217; Fred Bould, Sewickley; John Wadsworth, Pittsburgh, both of Pa.

[73] Assignee: Leonard Schwartz, Pittsburgh, Pa.

[21] Appl. No.: 100,951

[22] Filed: Sep. 25, 1987

[51] Int. Cl.[5] ..... A63B 21/00

[52] U.S. Cl. ..... 272/93; 272/62; 272/120

[58] Field of Search ..... 272/62, DIG. 4, 63, 272/70.3, 93, 144, 134, 120; 297/5, 6; 248/165, 423

[56] References Cited

U.S. PATENT DOCUMENTS

| | | | |
|---|---|---|---|
| 3,707,285 | 12/1972 | Martin | 272/62 |
| 4,341,378 | 7/1982 | Agyagos | 272/62 |
| 4,369,966 | 1/1983 | Silberman et al. | 272/62 |
| 4,620,701 | 11/1986 | Mojden | 272/63 |
| 4,720,100 | 1/1988 | DuBuy | 272/134 |

FOREIGN PATENT DOCUMENTS

| | | | |
|---|---|---|---|
| 2148726 | 6/1985 | United Kingdom | 272/93 |

*Primary Examiner*—S. R. Crow

*Attorney, Agent, or Firm*—Alder, Cohen & Grigsby

[57] ABSTRACT

The present invention pertains to an apparatus for exercising. The exercise apparatus is comprised of a first horizontal member and a second horizontal member in spatial relationship to the first horizontal member. A horizontal cross member is disposed anteriorly to the first and second horizontal members and is essentially perpendicular thereto. A platform supports the first horizontal member, the second horizontal member, and the horizontal cross member. The platform has a first vertical axis which extends through a first location where the first horizontal member is supported by the platform, and a second vertical axis extending through a second location where the second horizontal member is supported by the platform. The platform also defines an open region which extends between the first and second horizontal members and below the horizontal cross member. There is also included means for attaching the first horizontal member, the second horizontal member and the horizontal cross member to the platform such that the first and second horizontal members and the horizontal cross member are each able to be fixedly adjusted with respect to height, and the first and second horizontal members are each able to rotate about the first vertical axis and the second vertical axis, respectively.

8 Claims, 2 Drawing Sheets

STRENGTH-ENDURANCE EXERCISE APPARATUS

FIELD OF THE INVENTION

The present invention relates to exercise equipment. More specifically, the present invention relates to exercise equipment that is capable of coupling the development of strength and aerobic capacity throughout the human body.

BACKGROUND OF THE INVENTION

Strength training as it is traditionally performed (low number of repetitions with heavy weights) tends to cause the muscle fibers involved to enlarge (hypertrophy). There is little beneficial effect upon the cardiovascular system. Indeed, it is thought by many that a preponderance of such training may produce certain adverse effects upon the heart itself as well as untoward effects upon the arterial blood pressure.

Efforts to increase the number of repetitions and to make weight training strategies more continuous, etc., by having the exerciser move swiftly from one "station" to the next with only short pauses, have also failed to produce significant benefits with respect to endurance (aerobic) capacity. Thus subjects trained by the so-called "circuit" system, while achieving relatively high heart rates during the exercise, have not, generally speaking, increased their oxygen uptake capacity (work capacity) significantly over extended training periods.

These facts provoke the question as to whether or not strength oriented physical training can work toward the betterment of the cardiovascular system. This improvement would include such elements as slowing of the heart rate both at rest and at any greater workloads, usually lowering of the systemic blood pressure, along with various enzymatic and other metabolic changes that are readily measurable.

The crucial flaw in systems that attempt to couple strength and aerobic capacity may be their general failure to employ sufficient muscle mass during given exercises. Thus strength trainers typically work one or a few muscle groups at a time. The high heart rates achieved under those conditions do not represent the same physiologic events that general high heart rates during continuous (aerobic) exercise (jogging, brisk walking, swimming, rowing, bicycling) that employ a relatively large percentage of the body's muscle simultaneously.

There have been several devices put forth that attempt to achieve simplicity in design and do not utilize weights other than the user's own body weight for exercising. U.S. Pat. No. 4,114,873 to Jones discloses a skate exercise device. The user attaches skates to his feet for exercising various parts of the body by twisting and stretching through the movement of the legs in various back and forth or arcing motions. U.S. Pat. No. 2,819,755 to Burger, et al. discloses a physical rehabilitation device that aids a user in developing ambulatory skills. U.S. Pat. No. 277,399 to Worthington shows an exercise device of a tripodal form in which a user positions himself therein to exercise. Canadian Patent No. 993,910 to Simon shows a therapeutic traction apparatus which is akin to parallel bars but on which an individual may subject the spine to traction by suspending the body when it is suspended only by the arms. The problems with the aforementioned devices is that they do not combine the ability to couple strength and aerobic capacity. Moreover, the aforementioned devices are limited to the extent that they allow a user flexibility (range of motion) while using the device.

Circuit training systems are not alone in attempting to couple strength and aerobic capacity. One such concept which has met with much greater success in achieving the development of strength and aerobic capacity concurrently uses the idea of converting a pair of individual dumbbells to specially designed hand weights. U.S. Pat. Nos. 4,351,526; 4,627,618 L. Schwartz teach the development of strength during aerobic exercise while utilizing the hand weights. The preferred manner of exercising with the hand weights disclosed in the two patents and the one patent application to L. Schwartz is described in the publications entitled *HeavyHands: The Ultimate Exercise* and *Heavy Hands Walking*, by Leonard Schwartz, M.D. published in 1982 and 1987, respectively. While these patents disclose devices which also are capable of coupling the development of strength and aerobic capacity, they are defined upon work performed by the free motion of the hands and arms.

There is additional usefulness for an exercise apparatus that permits physical training of the body simultaneously for strength and aerobic capacity and which can be applied to all muscle groups of the body using body weight as the only resistance required. The entire bodyweight is ideally suited to serve as the resistance for strength-endurance training. This apparatus is designed to allow for the simultaneous action of a great muscle mass in lifting the body repeatedly and over relatively prolonged periods of time. This combined work, which includes a large strength component, cannot be accomplished by any combination of muscle groups activated in sequence. The apparatus structure lends itself to the careful design of combined movements and to the improvisation of such combined movements.

SUMMARY OF THE INVENTION

The present invention provides for the ability to concurrently develop strength and aerobic capacity. The present invention utilizes a first horizontal member and a second horizontal member in spatial relationship and a horizontal cross member to enable a user to accomplish a wide range of exercises to develop various muscle groups in the body while experiencing an aerobic level of exercise. The first and second horizontal members are able to rotate about a first and second vertical axis, respectively, and to be adjusted with respect to height, as is the horizontal cross member to maximize the effects and ranges of the exercises. The invention is a simple apparatus that makes for the execution of a variety of combined movements of the arms, legs and trunk of the human body. The body weight is the only resistance required. The varied manipulations of the body, supported by this embodiment, can produce the highest product of work and strength (strength-endurance) of any extant method. The simplicity of this apparatus makes its expense a small fraction of that of conventional apparatuses that cannot produce equivalent fitness benefits.

The present invention pertains to an apparatus for exercising. The exercise apparatus is comprised of a first horizontal member and a second horizontal member in spatial relationship to the first horizontal member. A horizontal cross member is disposed anteriorly to the first and second horizontal members and is essentially perpendicular thereto. A platform supports the first horizontal member, the second horizontal member, and the horizontal cross member. The platform has a first vertical axis which extends through a first location where the first horizontal member is supported by the platform, and a second vertical axis extending through a second location where the second horizontal member is supported by the platform. The platform also defines an open region which extends between the first and second horizontal members and below the horizontal cross member. There is also included means for attaching the first horizontal member, the second horizontal member and the horizontal cross member to the platform such that the first and second horizontal members and the horizontal cross member are each able to be fixedly adjusted with respect to height, and the first and second horizontal members are each able to rotate about the first vertical axis and the second vertical axis, respectively.

In a preferred embodiment, the first and second horizontal members and the horizontal cross member are tubular and hollow. Additionally, the first and second horizontal tubular members have a free end and a handle disposed thereon for gripping each horizontal tubular member, and the horizontal tubular cross member is able to support at least 250 pounds.

In a more preferred embodiment, the platform has a first and second post extending vertically therefrom for supporting the first and second horizontal members, respectively. The first and second posts are parallel and disposed opposite to each other with the open region therebetween. The first vertical axis is defined by the first post, and the second vertical axis is defined by the second post. Furthermore, the platform has a third and fourth post extending vertically therefrom for supporting the horizontal cross member. The third post is parallel to the first post and adjacent thereto, and the fourth post is parallel to the second post and adjacent thereto. The third and fourth posts are disposed opposite to each other with the open region therebetween.

In an even more preferred embodiment, the means for attaching includes a first and second means for attaching the first horizontal member and the second horizontal member, respectively, to the first and second posts, respectively, such that the first and second horizontal members are each able to be fixedly adjusted with respect to height, and the first horizontal member is able to rotate about the first vertical axis and the second horizontal member is able to rotate about the second vertical axis. Moreover, the means for attaching includes a third and fourth attaching means for attaching the horizontal cross member to the third and fourth posts, respectively, such that the horizontal cross member is able to be fixedly adjusted with respect to height. The first, second, third and fourth posts are hollow and the first and second horizontal members each have a flanged end such that the flanged end of the first horizontal member fits into the hollow first post through the first attaching means, and the flanged end of the second horizontal member fits into the hollow second post through the second attaching means. The horizontal cross member has a first and second flanged end such that the first and second flanged ends of the horizontal cross member fit into the hollow third and fourth posts, respectively, through the third and fourth attaching means, respectively.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENT

Figure 1:
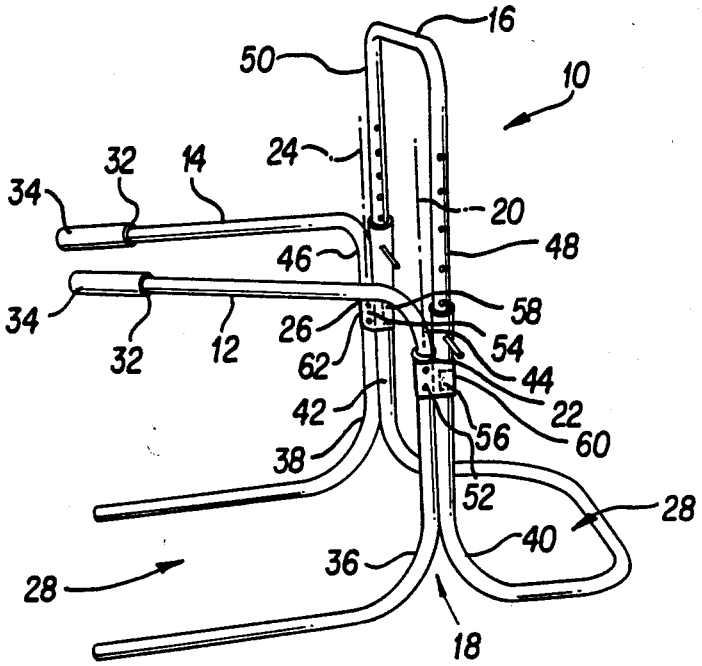
FIG. 1 is a perspective view of the exercise apparatus.

Referring now to the drawings, wherein like reference numerals designate identical or corresponding parts throughout the several views, and more particularly to FIG. 1 thereof, there is shown an apparatus 10 for exercising. The exercise apparatus 10 is comprised of a first horizontal member 12 and a second horizontal member 14 in spatial relationship to the first horizontal member 12. A horizontal cross member 16 is disposed anteriorly to the first and second horizontal members 12, 14 and is essentially perpendicular thereto. A platform 18 supports the first horizontal member 12, the second horizontal member 14, and the horizontal cross member 16. The platform 18 has a first vertical axis 20 which extends through a first location 22 where the first horizontal member 12 is supported by the platform 18, and a second vertical axis 24 extending through a second location 26 where the second horizontal member 14 is supported by the platform 18. The platform 18 also defines an open region 28 which extends between the first and second horizontal members and below the horizontal cross member. There is also included means 30 for attaching the first horizontal member 12, the second horizontal member 14 and the horizontal cross member 16 to the platform 18 such that the first and second horizontal members 12, 14 and the horizontal cross member 16 are each able to be fixedly adjusted with respect to height, and the first and second horizontal members 12, 14 are each able to rotate about the first vertical axis 20 and the second vertical axis 24, respectively.

More specifically, the first and second horizontal members 12, 14 are preferably tubular and hollow to facilitate ease of gripping and movement thereof by a user. The first and second horizontal members each have a free end 32 with a handle 34 disposed thereon to aid a user in gripping the free end 32 of the first and second horizontal tubular members 12, 14. The first horizontal member 12 and the second horizontal member 14 are in spatial relationship to each other. They preferably are positioned approximately 7–8 feet apart. The first horizontal member 12 is capable of rotating about a first vertical axis 20 and the second horizontal member 14 is capable of rotating about a second vertical axis 24.

The horizontal cross member 16 is also preferably tubular and hollow to facilitate ease of gripping and adjusting by a user. Ideally, the horizontal cross member 16 should be able to support at least 250 pounds. The horizontal cross member 16 is positioned essentially perpendicular to the essentially parallel first and second horizontal members 12, 14.

The platform 18 which supports the first and second horizontal members 12, 14 and the horizontal cross member 16 preferably has four posts extending vertically therefrom. The first post 36 and second post 38 support the first and second horizontal members 12, 14, respectively. The first and second posts 36, 38 are parallel and disposed on opposite sides of an open region 28. The first vertical axis 20 is defined by the first post 36 and the second vertical axis 24 is defined by the second post 38 with the first and second vertical axes 20, 24 essentially being the longitudinal axes of the first and second posts 36, 38. The third post 40 and fourth post 42 support the horizontal crossing member 16. The third post 40 is parallel to the first post 36 and preferably adjacent thereto, and the fourth post 42 is parallel to the second post 38 and preferably adjacent thereto. The third and fourth posts 40, 42 are disposed on opposite sides of the open region 28.

The four posts are preferably tubular and hollow and have a diameter which allows the flanged end 44 of the first horizontal member 12, the flanged end 46 of the second horizontal member 14, and the first flanged end 48 and second flanged end 50 of the horizontal crossing member 16 to fit into the first, second, third and fourth posts 36, 38, 40, 42, respectively. The first post 36 with the adjacent third post 40 should be at least a distance from the second post 38 with the adjacent fourth post 42 such that a user (not shown) hanging by his arms from the horizontal cross member 16 does not have any swinging movement or lifting movement impeded by the four posts. The distance between the first post 16 and the adjacent third post 40 from the second post 38 and the adjacent fourth post 42 should be between 1 ft. and 8 ft. and preferably 3 feet. The third and fourth posts 40, 42 which are adjacent to the first and second posts 36, 38, respectively, should be such that the horizontal cross member 16 can easily be raised and lowered independently with respect to the level of the first and second horizontal members 12, 14. This is necessary for the accomplishment of the combined exercises in which both hands are positioned on the horizontal cross member 16; small variations in the height of the horizontal cross member make for sizeable variations in the biomechanical aspects of the exercises which are performed on the exercise apparatus 10.

The means for attaching 30 includes first means 52 and second means 54 for attaching the first horizontal member 12 and the second horizontal member 14, respectively, to the first and second posts 36, 38, respectively, such that the first and second horizontal members 12, 14 are each able to be fixedly adjusted with respect to height and the first horizontal member 12 is able to rotate about the first vertical axis 20 and the second horizontal member 24 is able to rotate about the second vertical axis 24. The means for attaching 30 also includes a third means 56 and fourth means 58 for attaching the horizontal cross member 16 to the third and fourth posts 40, 42, respectively, such that the horizontal cross member 16 is able to be fixedly adjusted with respect to height. Preferably, the first, second, third and fourth attaching means 52, 54, 56 and 58 are bushings which fit into the hollow posts and are able to receive the flanged ends of the members. The platform 18 with the first and second horizontal members 12, 14 it supports and the horizontal cross member 16 it supports are so positioned that an open region 28 exists extending between the first and second horizontal members 12, 14 and below the horizontal cross member 16. This open region 28 allows the user to quickly move between the first and second horizontal members 12, 14 to the horizontal cross member 16, and also allows two users to use the exercise apparatus 10 at the same time. For instance, one user can be gripping the handles 34 on the first and second horizontal members 12, 14, and a second user can be gripping the horizontal cross member 16.

The first and second horizontal members 12, 14 and the horizontal cross member 16 may be constructed of any material such as metal or plastic so long as they are able to support the upper extremes of the human body weight. The floor platform must be heavy enough to remain stable during extreme variations of this type of exercise performed by persons of varying weight and stature.

Figure 3:
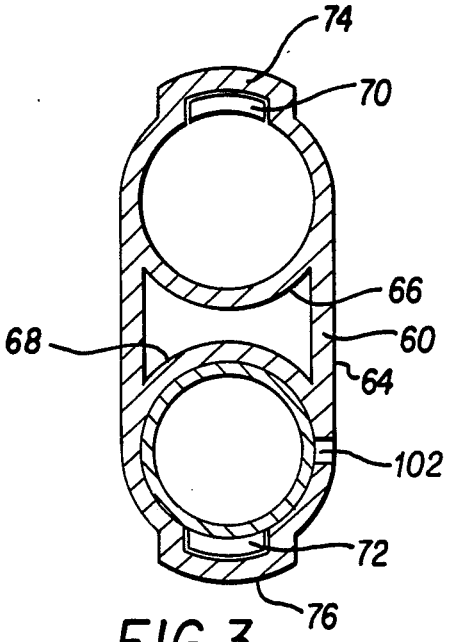
FIG. 3 is a sectional view taken along line 3—3 of FIG. 2.
Figure 2:
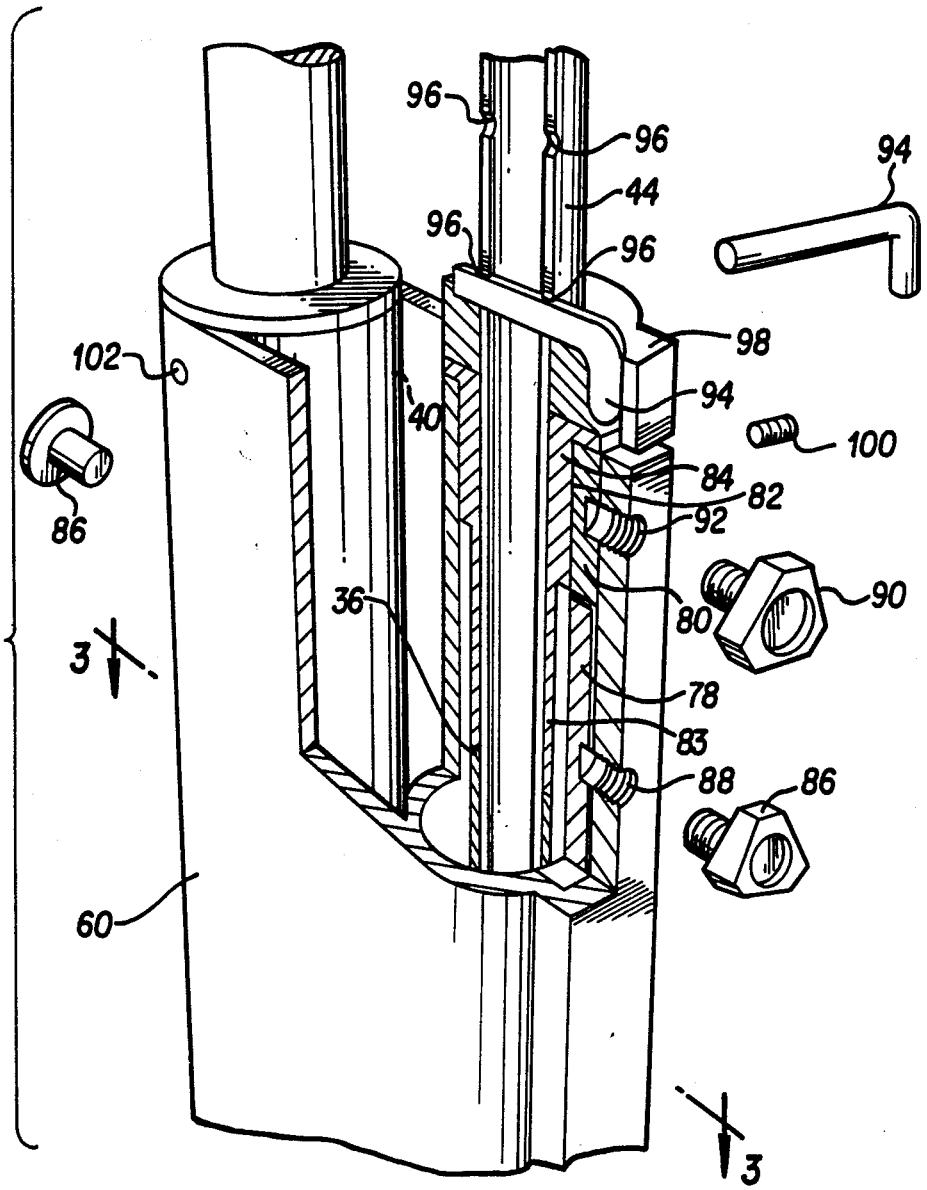
FIG. 2 is a perspective view of the post clamps of FIG. 1.

In a preferred embodiment, the first post 36 and the third post 40 are joined together by a first clamp 60, and the second post 38 and the fourth post 42 are joined together by a second clamp 62 as shown in FIG. 2. The first clamp 60 is designed to fit over the first post 36 and the third post 40 to fixedly position them in place. The second clamp 62 is similarly designed to fixedly position second post 38 and fourth post 42 in place. The first clamp 60 and the second clamp 62 are of the same design and each essentially have a common wall 64 that links a first tubular portion 66 and a second tubular portion 68. As shown in FIG. 3, which is an overhead view of the first clamp 60, the first tubular portion 66 and the second tubular portion 68 fit over the two posts they are to hold together. There is a first clamp shoe 70 disposed in the tubular portion at a location at the first end 74 of the first clamp 60. A second clamp shoe 72 is disposed in the second tubular portion 68 at the second end 76 of the clamp 60.

Referring again to FIG. 2, the first and second clamp shoe 70, 72 each have a first clamp section 78 and a second clamp shoe section 80. The first clamp section is for the purpose of anchoring the platform 18 in place. The second clamp shoe section 80 provides friction for resistance during rotation of the first horizontal member 12 or the second horizontal member 14.

A tubular hollow bushing means 82 serves as the first, second, third and fourth attaching means 52, 54, 56, 58 and includes a first bushing section 83 that fits inside each post and a second bushing section 84 that is disposed above each post and connected to the first bushing section 83. The flanged end 44 of the first horizontal member 12 is positioned inside the bushing 82. The second tubular portion 68 of clamp 60 is positioned around the first post 36 and the second section 84 of the bushing means. A first hand knob 86 is threaded through first hole 88 of clamp 60 which is positioned to communicate with the first port 36, fixedly securing clamp 60 to the first post 36 of platform 18. A second hand knob 90 is threaded through second hole 92, which is positioned above the first post 36 and communicates with the second section 84 of bushing means 82, the tightening of the second hand knob 90 causes the desired pressure to be applied against the second section 84 of bushing means 82, consequently causing friction against flanged end 44 of the first horizontal member 12 during rotation thereof.

The bushing means 82 includes a pin 94 positioned in and through a pin hole 96 disposed in the flanged end 44 of the first horizontal member 12. There are several of these pin holes 96 at discrete distances in each of the flanged ends. By placing the pin 94 in a desired pin hole 96 the height of the first or second horizontal member 12, 14 and the height of the horizontal cross member 16 can be chosen. Once the pin 94 is in place in a desired pin hole 96, the flanged end 44 is lowered into the first post 36 until the pin 94 is seated in a pin collar 98 which is also part of the bushing means 82.

Referring to FIG. 3, a set screw 100 is positioned in anchoring hole 102. Anchoring hole 102 penetrates the clamp 60 as well as the second section 84 of the bushing means 82, allowing set screw 100 to hold the bushing means 82 in place so it cannot rotate. When the first horizontal member 12 is rotated about the first vertical axis 20, the flanged end 44 rotates in the first post 36 and bushing means 82 since they are fixed in place. The pin collar 98 is able to rotate with the flanged end 44. The second hand knob 90 is not able to prevent rotation of the flanged end 44, but only to increase or decrease the resistance of the rotation.

The third and fourth posts 40, 42 do not necessarily require the above described post bushing flanged end arrangement, since the horizontal cross bar 16 they support does not rotate. The horizontal cross bar 16 may, for example, be held in place in third and fourth posts 40, 42 by a 94 positioned through a post pin hole 102 in the third or fourth posts 40, 42 and a pin hole 96 of the desired height in the first and second flange ends 48, 50.

When using this apparatus 10 the upper torso becomes participant in the act of weight bearing through reliance by the user on his arms and the first and second horizontal members 12, 14; a task obviously left to the lower extremities in usual bipedal life. By contributing leg strength to upper torso weight-bearing rhythmic movements the arms may gradually, through training, assume more of the burden of supporting the body's weight. The arms become stronger and more work capable simultaneously as the transition from leg preponderance toward greater arm contribution to combined movements is accomplished. The legs, massively muscled, generally assume the stereotyped chore of supporting the erect human body during locomotion. With the exercise apparatus 10, given the progressively greater participation of the arms during this form of training, the legs may come to perform tasks impossible during movements in which, in fact, the arms do not participate; since balance is not required during partial arm support of the bodyweight, the legs can be indulged with a variety and intensity of movements unthinkable without this embodiment. Indeed, the apparatus 10 allows the exerciser access to movements impossible during even the most advanced forms of dance and athletics. Stated otherwise, the exercise apparatus 10 makes possible the addition of certain physiologic functions to the body's musculature that were hitherto unavailable; increased strength, endurance and skill to all of the body's muscle by a wide variety of combined movements constructed to include great percentages of body muscle in simultaneous actions. The divided support of the body's weight also reduces substantially the risk of injury to the body parts that contribute to the activity; the muscles, bones, ligaments and tendons specifically. Likewise, the interest of the user may be enlisted by the diversity and increasable intensity so as to diminish the likelihood of abandonment of training. The nature of the method and the apparatus 10 that implements it makes it useful for the most sedentary beginner. It is also true that no fitness level precludes further improvement of some function or functions by the use of the apparatus 10 and the exercise procedure it implements.

During these combined movements thusly supported by the exercise apparatus 10, high levels of work efficiency may become established and may be maintained so long as training continues. The adjustability of the exerciser apparatus 10 facilitates the control of mechanical "stresses" on particular body parts, by varying the angles through which limbs and trunk act during exercise movements therewith. In particular, the distance between the first and second horizontal members 12, 14, the height of the bars, and the height of the horizontal cross member 16, make for infinite variability of combined movements. The exercise apparatus 10 and the principles of its use make possible the continuation of beneficial exercise despite certain single or multiple injuries of the body's motor apparatus. This advantage accrues from the inordinate flexibility of the apparatus 10, the diversity of movements it employs, as well as the versatility of the adjustments of the apparatus 10 itself.

The joints of feet, legs, knee and hip, along with the lower spinal segments, are accorded even greater freedom of motion during exercise with the apparatus 10 and this results in certain corresponding training effects. The role of the upper torso in sharing in the body's support, allows for unique forms of leg action otherwise unavailable to the user. The body thusly supported may remain airborne longer during jumping or hopping movements. This allows sufficient time for leg actions not reproducible when the body's return to earth is influenced irrevocably by the pull of gravity. While the upper torso is retarding the drop to earth the legs can execute movements which involve muscle groups that are to a great extent neglected during conventional exercise of the aerobic type. The abductor and adductor muscles (which move the thighs away from and back to the midline respectively) as well as the hamstring groups gain especial advantage from the use of the apparatus. At the same time the arms strengthen and gain work capability from these "eccentric" contractions which retard the body's acceleration toward earth.

Other muscle groups benefit uniquely from the use of the apparatus 10. The abdominal and low back muscles may be trained for strength-endurance effectively. A variety of flexions and extensions of the spine, as well as a wide range of torsions of the trunk may be performed rhythmically with great effect in the course of training the cardiovascular mechanisms of the body. By simply varying its height the horizontal cross member 16 can be used to effectively train a variety of muscle groups. When, for instance its height is raised it lies in a position to effectively train the bicep muscles of the arm by merely grasping the bar in the palm-up position during combined body-lifting movements. In each instance leg contribution is used to complement the beginner's first efforts, this effort being gradually withdrawn as the arms train.

A variety of movement tempos and ranges of motion are essential to the most beneficial training with the exercise apparatus 10. Though the body weight may be considered a relatively constant variable, the former variables can be varied substantially while keeping the total workload at any stage in the training process virtually constant. These variations can thus emphasize speed at one moment and strength at another, without neglecting the endurance factors essential to the performance of the continuous work that is known to be beneficial to the cardiovascular system. At fast tempos the arms' body support and eccentric work tend to lessen; at slow tempos the support (strength) factor is increased but the work tends to be lessened by the fewer repetitions per unit time involved.

Aside from the great strength and endurance that is gained with proper use of the apparatus 10 and the method by healthy subjects, the increasing range of motion at various joints results in greater suppleness, i.e., flexibility of the body. Many of the movements to be used with my apparatus were specifically designed to enhance these functional capabilities, without neglecting the user's strength-endurance.

For proper understanding of the use of the apparatus 10, it is important to know that combined effects described herein cannot be duplicated by any amount of physical training that attempts to isolate the muscle groups for individual treatment, i.e., arm and leg and trunk training, cannot produce the effect of training these bodily elements simultaneously.

Although the invention has been described in detail in the foregoing for the purpose of illustration, it is to be understood that such detail is solely for that purpose and that variations can be made therein by those skilled in the art without departing from the spirit and scope of the invention as described in the following claims.

We claim:

1. An apparatus for exercising comprising:

a first horizontal member;

a second horizontal member in spatial relationship to the first horizontal member;

a horizontal cross member disposed anteriorly to the first and second horizontal members and essentially perpendicular thereto;

a platform for supporting the first horizontal member, the second horizontal member and the horizontal cross member, said platform having a first vertical axis extending through a first location where the first horizontal member is supported by the platform, said platform having a second vertical axis extending through a second location where the second horizontal member is supported by the platform, said platform defining an open region which extends between the first and second horizontal members and below the horizontal cross member, said platform having a first and second post extending vertically therefrom for supporting the first and second horizontal members, respectively, said first and second posts being parallel and disposed opposite to each other with the open region therebetween, said first vertical axis being defined by the first post, and said second vertical axis being defined by the second post, and wherein the platform has a third and fourth post extending vertically therefrom for supporting the horizontal crossing member, the third post being parallel to the first post and adjacent thereto, and the fourth post being parallel to the second post and adjacent thereto, said third and fourth posts being disposed opposite to each another with the open region therebetween; a first and second means for attaching the first horizontal member and the second horizontal member, respectively, to the first and second post, respectively, such that the first and second horizontal members are each able to be fixedly adjusted with respect to height and the first horizontal member is able to rotate about the first vertical axis and the second horizontal member is able to rotate about the second vertical axis, and a third and fourth attaching means for attaching the horizontal cross member to the third and fourth posts, respectively, such that the horizontal cross member is able to be fixedly adjusted with respect to height; and wherein the first, second, third and fourth posts are hollow; the first and second horizontal members each have a flanged end such that the flanged end of the first horizontal member fits into the hollow first post through the first attaching means, the flanged end of the second horizontal member fits into the hollow second post through the second attaching means; and the horizontal cross member has a first and second flanged end such that the first and second flanged ends of the horizontal cross member fit into the hollow third and fourth posts, respectively, through the third and fourth attaching means, respectively.

2. An exercise apparatus as described in claim 1 wherein the first, second, third and fourth attaching means are first, second, third and fourth bushing means, respectively, which are disposed in the respective posts and receive the respective flanged ends of the first and second horizontal members and the horizontal cross member; and wherein the platform includes a first clamp holding the first and third posts together and a second clamp for holding the second and fourth posts together.

3. An exercise apparatus as described in claim 2 wherein the first and second clamps each have a first hole, a second hole, a third hole and a fourth hole; and wherein each of the flanged ends have at least one pin hole passing therethrough; and wherein the first and second bushing means are each comprised of a first bushing section that fits inside the respective posts and a second bushing section that is connected to the first bushing section and disposed above the respective post such that the flanged end of the first horizontal member and the flanged end of the second horizontal member are able to be positioned inside the first and second bushing sections; a first hand knob threaded through the first hole of the clamp such that the first hand knob contacts the respective post and fixedly secures the clamp to the respective post; a second hand knob threaded through the second hole of the clamp and contacting the second section of the bushing means such that the second hand knob causes the second bushing section to press against the flanged end of the respective member; a pin collar disposed on the second bushing section such that the respective flanged end is able to be fitted therethrough; and a pin disposed in and through a pin hole of the respective flanged ends, said pin preventing the respective flanged ends from moving down into the respective post when said pin is seated in said pin collar; and wherein the third and fourth bushing means are each comprised of a pin that is disposed in and through the third hole of the clamp, a pin hole of the respective flanged end, and the fourth hole of the clamp.

4. An apparatus for exercising comprising:

a first horizontal tubular member that is hollow and has a free end and a flanged end;

a first handle disposed at the free end of the first horizontal tubular member for gripping;

a second horizontal tubular member which is hollow and has a free end and a flanged end, said second horizontal tubular member being in spatial relationship to the first horizontal tubular member;

a second handle disposed at the free end of the second horizontal tubular member for gripping said second horizontal tubular member;

a horizontal tubular cross member disposed anteriorly to the first and second horizontal tubular members and essentially perpendicular thereto, said horizontal tubular cross member being able to support at least 250 pounds;

a platform for supporting the first horizontal member, the second horizontal member and a horizontal cross member, said platform defining an open region which extends between the first and second horizontal members and below the horizontal cross member, said platform having a first and second hollow post extending vertically therefrom for supporting the first and second horizontal members respectively, said first and second posts being parallel and disposed opposite to each other with the open region there between, said first post defining a first vertical axis, said second post defining a second vertical axis; a third and a fourth post extending vertically from the platform for supporting the horizontal cross member, the third post being parallel to the first post and adjacent thereto, and the fourth post being parallel to the second post and adjacent thereto, said third and fourth posts being disposed opposite to each other with the open region there between, said platform having a first clamp holding the first and third posts together and a second clamp for holding the second and fourth posts together;

a first and second bushing means for attaching the first horizontal member and the second horizontal member, respectively, to the first and second posts, respectively, such that the flanged end of the first horizontal member fits into the hollow first post through the first bushing means, the flanged end of the second horizontal member fits into the hollow second post through the second bushing means, and the first and second horizontal members are each able to be fixedly adjusted with respect to height, and the first horizontal member is able to rotate about the first vertical axis and the second horizontal member is able to rotate about the second vertical axis; and a third and fourth bushing means disposed in the third and fourth posts, respectively, said first and second flanged end of the horizontal cross member fitting into the hollow third and fourth posts, respectively, through the third and fourth bushing means, respectively, such that the horizontal cross member is able to be fixedly adjusted with respect to height whereby the user can easily and immediately move between the cross member and the first and second horizontal members to perform corresponding exercises thereon and utilize shared body weight as primary weight resistance to achieve increased aerobic and strength capacity.

5. An apparatus for exercising comprising:

a first horizontal member;

a second horizontal member in spatial relationship to the first horizontal member;

a horizontal cross member disposed anteriorly to the first and second horizontal members and essentially perpendicular thereto;

a platform for supporting the first horizontal member, the second horizontal member and the horizontal cross member, said platform having a first vertical axis extending through a first location where the first horizontal member is supported by the platform, said platform having a second vertical axis extending through a second location where the second horizontal member is supported by the platform, said platform defining an open region which extends between the first and second horizontal members and below the horizontal cross member, said platform having a first and second hollow post extending vertically therefrom for supporting the first and second horizontal members, respectively, said first and second posts being parallel and disposed opposite to each other with the open region therebetween, said first vertical axis being defined by the first post, and said second vertical axis being defined by the second post, and said platform having a third and fourth hollow post extending vertically therefrom for supporting the horizontal cross member, the third post being parallel to the first post and adjacent thereto, and the fourth post being parallel to the second post and adjacent thereto, said third and fourth post being disposed opposite to each other with the open region therebetween;

first and second means for attaching the first horizontal member and the second horizontal member, respectively, to the first and second post, respectively, such that the first and second horizontal members are each able to be fixedly adjusted with respect to height and the first horizontal member is able to rotate about the first vertical axis and the second horizontal member is able to rotate about the second vertical axis; and third and fourth means for attaching the horizontal cross member to the third and fourth post, respectively, such that the horizontal cross member is able to be fixedly adjusted with respect to height, the first and second horizontal members each have a flanged end such that the flanged end of the first horizontal member fits into the hollow first post to the first attaching means, the flanged end of the second horizontal member fits into the hollow second post to the second attaching means, and the horizontal cross member has a first and second flanged end such that the first and second flanged ends of the horizontal cross member fit into the hollow third and fourth posts, respectively, through the third and fourth attaching means, respectively.

6. An exercise apparatus as described in claim 5 wherein the first, second, third and fourth attaching means are first, second, third and fourth bushing means, respectively, which are disposed in the respective posts and receive the respective flanged ends of the first and second horizontal members and the horizontal cross member; and wherein the platform includes a first clamp holding the first and third posts together and a second clamp for holding the second and fourth posts together.

7. An exercise apparatus as described in claim 6 wherein the first and second clamps each have a first hole, a second hole, a third hole and a fourth hole; and wherein each of the flanged ends have at least one pin hole passing therethrough; and wherein the first and second bushing means are each comprised of a first bushing section that fits inside the respective posts and a second bushing section that is connected to the first bushing section and disposed above the respective post such that the flanged end of the first horizontal member and the flanged end of the second horizontal member are able to be positioned inside the first and second bushing sections; a first hand knob threaded through the first hole of the clamp such that the first hand knob contacts the respective post and fixedly secures the clamp to the respective post; a second hand knob threaded through the second hole of the clamp and contacting the second section of the bushing means such that the second hand knob causes the second bushing section to press against the flanged end of the respective member; a pin collar disposed on the second bushing section such that the: respective flanged end is able to be fitted therethrough; and a pin disposed in and through a pin hole of the respective flanged ends, said pin preventing the respective flanged ends from moving down into the respective post when said pin is seated in said pin collar; and wherein the third and fourth bushing means are each comprised of a pin that is disposed in and through the third hole of the clamp, a pin hole of the respective flanged end, and the fourth hole of the clamp.

8. An apparatus for exercising comprising:

a first horizontal member;

a second horizontal member in spatial relationship with the first horizontal member;

the horizontal cross member disposed anteriorly to the first and second horizontal members and essentially perpendicular thereto;

a platform for supporting the first horizontal member, the second horizontal member and the horizontal cross member, said platform having a first vertical axis extending through a first location where the first horizontal member is supported by the platform, said platform having a second vertical axis extending through a second location where the second horizontal member is supported by the platform, said platform defining an open region which extends between the first and second horizontal members though the horizontal cross member, said platform having a first and second hollow post extending vertically therefrom for supporting the first and second horizontal members, respectively, said first and second post being parallel and disposed opposite to each other with the open region therebetween, said first vertical axis being defined by the first post, and said second vertical axis being defined by the second post, and said platform having a third and fourth hollow post extending vertically therefrom for supporting the horizontal cross member, the third post being parallel to the first post and adjacent thereto, and the fourth post being parallel to the second post and adjacent thereto, said third and fourth post being disposed opposite to each other with the open region therebetween;

a first and second means for attaching the first horizontal member and the second horizontal member, respectively, to the first and second posts, respectively, such that the first and second horizontal members are each able to be fixedly adjusted with respect to height and the first horizontal member is able to rotate about the first vertical axis and the second horizontal member is able to rotate about the second vertical axis; and third and fourth means for attaching the horizontal cross member to the third and fourth posts, respectively, such that the horizontal cross member is able to fixedly adjusted with respect to height, and the first and second horizontal members each have a flanged end such that the flanged end of the first horizontal member fits into the hollow first post to the first attaching means, the flanged end of the second horizontal member fits into the hollow second post through the second attaching means, and the horizontal cross member has a first and second flanged end such that the first and second flanged ends of the horizontal cross member fit into the hollow third and fourth posts, respectively, through the third and fourth attaching means, respectively.

* * * * *